US005685545A

United States Patent [19]

Quinton

[11] Patent Number: 5,685,545

[45] Date of Patent: Nov. 11, 1997

[54] ARCHITECTURAL CONSTRUCTION GAME AND BUILDING BOARD THEREFOR

[75] Inventor: Roland Quinton, St-Ferdinand, Canada

[73] Assignee: Gestion Quinton Inc., St-Ferdinand, Canada

[21] Appl. No.: 634,856

[22] Filed: Apr. 19, 1996

[51] Int. Cl.[6] ..... A63F 3/00

[52] U.S. Cl. ..... 273/309; 108/159

[58] Field of Search ..... 273/148 R, 309; 108/93, 153, 154, 157, 159; 312/231

[56] References Cited

U.S. PATENT DOCUMENTS

| | | | |
|---|---|---|---|
| 3,185,114 | 5/1965 | Consin | 108/93 |
| 3,926,439 | 12/1975 | Chao et al. . | |
| 4,136,871 | 1/1979 | Meyers et al. . | |
| 4,484,745 | 11/1984 | Sleeper | 273/309 X |
| 4,632,040 | 12/1986 | Sheffer | 108/159 X |
| 4,654,762 | 3/1987 | Laverick . | |
| 5,154,498 | 10/1992 | Slater . | |
| 5,382,233 | 1/1995 | Brotz . | |
| 5,388,530 | 2/1995 | Jacobus . | |
| 5,405,146 | 4/1995 | Washington | 273/309 X |
| 5,421,270 | 6/1995 | Kelly | 273/309 X |
| 5,429,372 | 7/1995 | Spaziani et al. | 273/309 |
| 5,456,474 | 10/1995 | Geshkewich | 273/309 X |

*Primary Examiner*—William E. Stoll

*Attorney, Agent, or Firm*—Goudreau Gage Dubuc & Martineau Walker

[57] ABSTRACT

An architectural construction game including a building board is described herein. The building board includes a rectangular rigid board having recessed cavities in three corners and a transparent protecting sheet. A piece of VELCRO-type hook fastening material is provided in each cavity while pieces of VELCRO-type loop fastening material are provided on the undersurface of the protecting sheet so as to overly the cavities. The contact between the VELCRO-type hook fastening material and the VELCRO-type loop fastening material maintain the protective sheet onto the board. A plan may be inserted between the board and the protective sheet so as to assist in the assembly of an architectural construction.

15 Claims, 3 Drawing Sheets

ARCHITECTURAL CONSTRUCTION GAME AND BUILDING BOARD THEREFOR

FIELD OF THE INVENTION

The present invention relates to an architectural construction game. More specifically, the present invention relates to an architectural construction game including a building board.

BACKGROUND OF THE INVENTION

The prior art is replete with construction games for making downsized architectural structures with pieces of wood, metal, plastic, or the like.

These construction games may be divided in two broad categories. The first category is concerned with making downsized architectural structures that are not permanent, for example, using LEGO™ plastic blocks, MECANO™ kits, three-dimensional puzzles or the like.

The second category is concerned with making downsized architectural structures that are permanent. An example of the second category are the hand-crafted wooden structures, ashtrays, houses, etc. made of a plurality of conventional POPSICLE™ sticks glued together.

A drawback with this handy-craft is that it does not only require the user to have skills in miniature construction but also requires the user to have drawings skills so that he can draw the plans of his structure prior to the construction.

OBJECTS OF THE INVENTION

An object of the present invention is therefore to provide an improved architectural construction game and building board therefor.

SUMMARY OF THE INVENTION

More specifically, in accordance with the present invention, there is provided an architectural construction game comprising:

a building board including:

a board having a top surface provided with at least one recessed cavity having a predetermined depth suitable for housing a releasable fastening system consisting of two mutually engaging elements; each cavity being provided with the first of two releasably engaging elements mounted therein;

a protective sheet having an undersurface; the protective sheet being mountable so as to overly the top surface of the board; the second of two releasably engaging elements being mounted to the undersurface of the protective sheet in a position overlying the recessed cavity when the protective sheet is mounted to overly the top surface of the board so as to releasably engage the first of two engaging element;

a plan associated with the protective sheet of the building board;

a plurality of building elements adapted to be assembled onto the protective sheet according to the plan.

According to another aspect of the present invention, there is provided a building board for use in an architectural construction game, the building board comprising:

a board having a top surface provided with at least one recessed cavity having a predetermined depth suitable for housing a releasable fastening system consisting of two mutually engaging elements; each cavity being provided with the first of two releasably engaging elements mounted therein;

a protective sheet having an undersurface; the protective sheet being mountable so as to overly the top surface of the board; the second of two releasably engaging elements being mounted to the undersurface of the protective sheet in a position overlying the recessed cavity when the protective sheet is mounted to overly the top surface of the board so as to releasably engage the first of two engaging element.

According to yet another aspect of the present invention there is provided a kit of parts for constructing an architectural construction, the kit of parts comprising:

a plurality of building sticks;

a cutter device adapted to cut the building sticks;

a building board including:

a board having a top surface provided with at least one recessed cavity having a predetermined depth suitable for housing a releasable fastening system consisting of two mutually engaging elements; each cavity being provided with the first of two releasably engaging elements mounted therein;

a protective sheet made of a transparent material and having an undersurface; the protective sheet being mountable so as to overly the top surface of the board; the second of two releasably engaging elements being mounted to the undersurface of the protective sheet in a position overlying the recessed cavity when the protective sheet is mounted to overly the top surface of the board so as to releasably engage the first of two engaging element;

a plan mountable between the undersurface of the protective sheet and the top surface of the board.

Other objects, advantages and features of the present invention will become more apparent upon reading of the following non restrictive description of preferred embodiments thereof, given by way of example only with reference to the accompanying drawings.

DESCRIPTION OF THE PREFERRED EMBODIMENT

Figure 1:
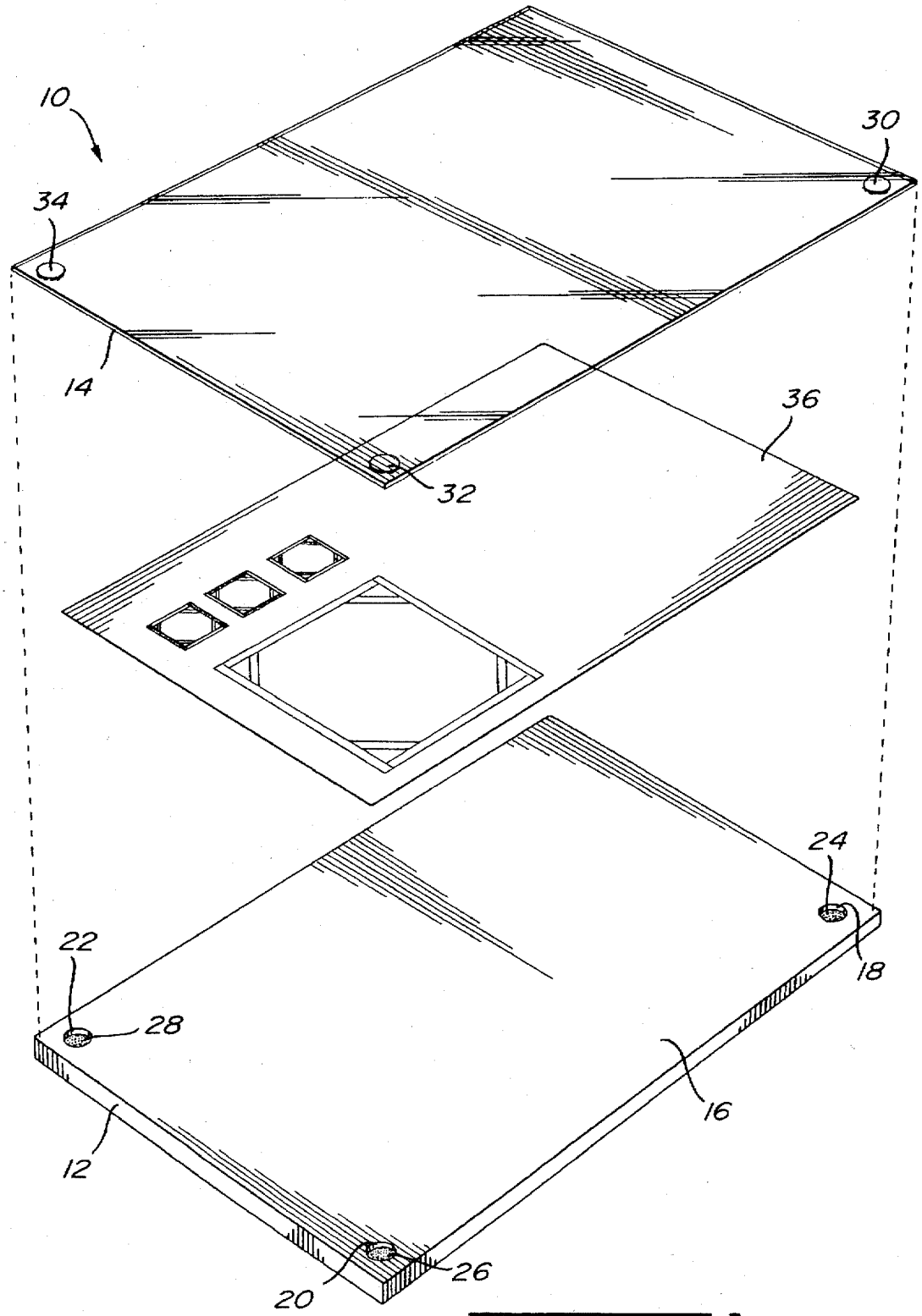
FIG. 1 is an exploded perspective view of a building board for an architectural construction game according to an embodiment of the present invention.

FIG. 1 of the appended drawings illustrates a building board 10 including a board 12 and a protective sheet 14.

The board 12 is rectangular, has a flat top surface 16 and is advantageously made of a rigid material such as, for example, wood. The top surface 16 is provided with three recessed circular cavity 18, 20 and 22 at three corners of the top surface 16.

Circular pieces of Velcro-type hook fastener material 24, 26 and 28 are mounted in the circular cavities 18, 20 and 22, respectively.

The protective sheet 14 is rectangular and is advantageously made of a transparent material such as, for example polyethylene such as MYLAR™, 3/1000 inch thickness or other similar materials. It is to be noted that the size of the protective sheet 14 is only slightly smaller than the size of the top surface 16 of the board 12.

The undersurface of the protective sheet 14 is provided with three circular pieces of Velcro-type loop fastener material 30, 32 and 34 positioned so as to overly cavities 18, 20 and 22, respectively, when the protective sheet 14 overlies the top surface 16 of the board 12.

FIG. 1 also illustrates a rectangular plan 36 which is smaller than the top surface 16 of the board 12 so that the three circular pieces of Velcro-type loop fastener material 30, 32 and 34 may enter the recessed cavities 18, 20 and 22 as will be described hereinafter.

In operation, the plan 36 may be sandwiched between the top surface 16 and the protective sheet 14. The protective sheet 14 is mounted so as to overly both the plan 36 and the top surface 16. The pieces of Velcro-type loop fastener material 30, 32 and 34 will therefore overly and releasably engage the pieces of Velcro-type hook fastener material 24, 26 and 28, respectively. The plan 36 will be visible through the transparent protective sheet 14 but will be protected by sheet and will be in an adequately stable position with respect to the sheet 14.

Figure 3:
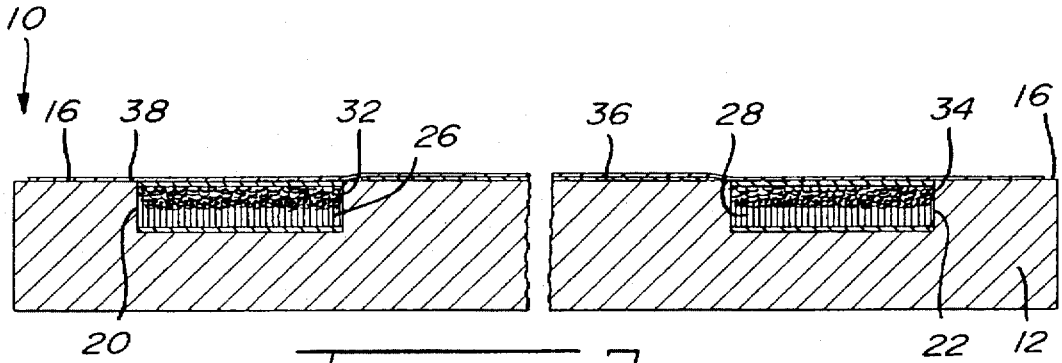
FIG. 3 is a sectional view taken along line 3—3 of FIG. 2.

As can be better seen from FIG. 3, the depth of the recessed cavities 18, 20 and 22 (only cavities 20 and 22 are shown in FIG. 3) is such that the protective sheet 14 presents an essentially flat top surface 38 when the pieces of Velcro-type loop fastener material 30, 32 and 34 engage the pieces of Velcro-type hook fastener material 24, 26 and 28, respectively. Indeed, only the thickness of the plan 36 causes a slight difference in height in the top surface 38. This feature enables a user to build a structure (not shown) on a flat surface as will be described hereinafter.

Figure 2:
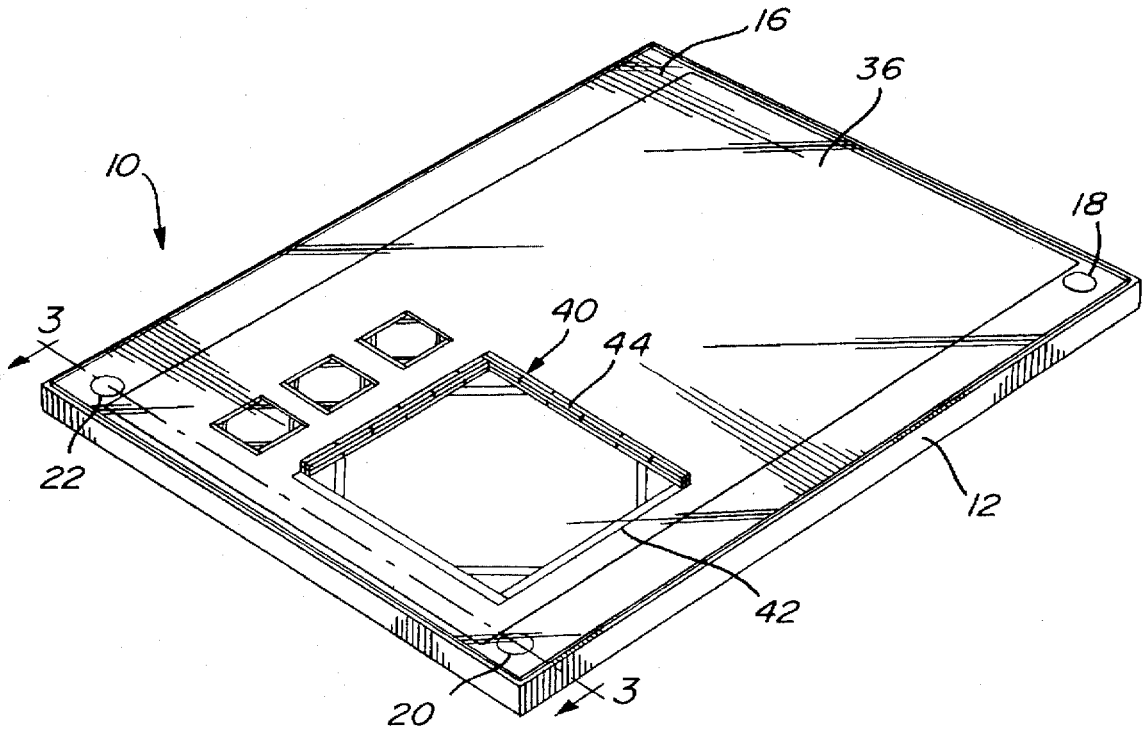
FIG. 2 is a perspective view of the building board of FIG. 1.

FIG. 2 of the appended drawings illustrates an assembled building board 10 and a structure 40 partially assembled according to markings 42 provided on plan 36.

The structure 40 is formed of a plurality of individual wooden sticks 44 which are glued together and to the top surface 38 of the protective sheet 14.

As will be apparent to one of ordinary skills in the art, conventional wood adhesive, such as, for example, carpenter's glue or polyvinyl acetate adhesive (PVA adhesive) do not strongly adhere to the material forming the protective sheet 14. Therefore, it is possible to glue the wooden sticks 44 to the protecting sheet 14 and to one another to follow the markings 42 of the plan 36 and thereby construct the structure defined by plan 36. Subsequently, the completed structure may be removed from the protective sheet without damaging either the completed structure or the protective sheet 14.

It is to be noted that the adequate stability of the plan 36 with respect to the protective sheet 14 is of some importance since the sticks 44 are glued to the protective sheet 14 in positions following the markings 42 of the plan 36. Therefore, if the plan 36 was moved with respect to the protective sheet 12, errors in the construction of the structure represented by the markings 42 might occur.

It is therefore possible to construct a plurality of planar structures from markings 42 on a plan 36. These planar structures may then be assembled together to form a tridimensional architectural construction (not shown).

Figure 4:
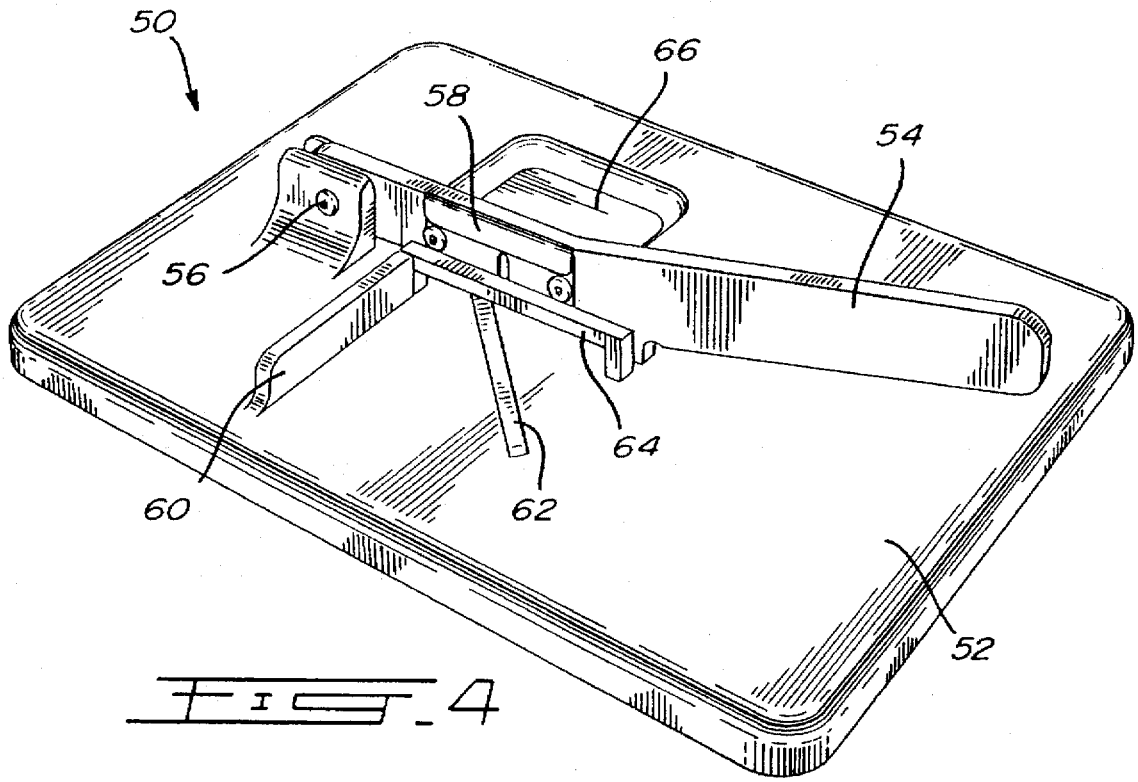
FIG. 4 is a perspective view of a cutting device according to an embodiment of an architectural construction game of the present invention.

Turning now to FIG. 4, a cutter device 50 for cutting the wooden sticks 44 will be described.

The cutter device 50 includes a base 52 and an arm 54 pivotally mounted to the base 52 through a pivot 56. A replaceable blade 58 is mounted to the arm 54 through fasteners 59.

The base 52 includes a fence 60 defining a right angle with the blade 58 and a channel 62 defining an angle of 45 degrees with the blade 58. A safety fence 64 is provided to prevent contact between the fingers of the user and the blade 58. Finally, a cavity 66 collects the discarded portions of wooded sticks 44.

In operation, the user may cut a wooden stick at right angle by contacting the stick and the fence 60 or may cut a wooden stick at a 45 degrees angle by inserting the stick in the channel 62. To cut a wooden stick at any other angle, the user may mark the desired angle on the wooden stick, visually align the mark and the blade 58 and then cut the wooden stick.

It is to be noted that the blade 58 may advantageously be a single edge razor blade.

As will be apparent to one of ordinary skill in the art, the protective sheet 14 and the plan 36 could be replaced by a single sheet of polyethylene or similar material onto which markings have been printed. Of course, this sheet would include the pieces of Velcro-type loop fastener material 30, 32 and 34, and the transparency of the sheet would not be required. However, this solution is more expensive since at least one different sheet of polyethylene such as MYLAR™, 3/1000 inch thickness or other similar material is required for each architectural construction.

It is also to be noted that the pieces of Velcro-type loop fastener and the pieces of Velcro-type hook fastener could be interchanged, e.g., pieces of Velcro-type loop fastener material could be mounted in the cavities 18, 20 and 22, and pieces of Velcro-type hook fastener material could be mounted to the undersurface of the protective sheet 14. Also, a different number of recessed cavities could be provided in the top surface 16 of the board 12, or the recessed cavities of different shapes could be provided.

As will be easily understood by one of ordinary skill in the art, the polyethylene, such as MYLAR™, forming the protective sheet 14 could be replaced by other suitable materials having the transparency and poor adherence to conventional wood glue characteristics.

Although the present invention has been described hereinabove by way of preferred embodiments thereof, it can be modified, without departing from the spirit and nature of the subject invention as defined in the appended claims.

What is claimed is:

1. An architectural construction game comprising:

a building board including:

a board having a top surface provided with at least one recessed cavity having a predetermined depth suitable for housing a releasable fastening system consisting of two mutually engaging elements; each cavity being provided with the first of two releasably engaging elements mounted therein;

a protective sheet having an undersurface; said protective sheet being mountable so as to overly the top surface of the board; the second of two releasably engaging elements being mounted to the undersurface of the protective sheet in a position overlying said at least one recessed cavity when the protective sheet is mounted to overly the top surface of the board so as to releasably engage said first of two engaging elements;

a plan associated with said protective sheet of said building board;

a plurality of building elements adapted to be assembled onto said protective sheet according to said plan.

2. A building board as defined in claim 1, wherein said protective sheet is made of a transparent material.

3. An architectural construction game as defined in claim 2, wherein said plan is mountable between the undersurface of the protecting sheet and the top surface of the board.

4. An architectural construction game as defined in claim 1, wherein one of said two mutually engaging elements of said building board consists of VELCRO-type hook fastener material, the other of said two mutually engaging elements consists of Velcro-type loop fastener material.

5. An architectural construction game as defined in claim 4, wherein the top surface of the board is rectangular, defining four corners, three of the four corners being provided with recessed cavities.

6. An architectural construction game as defined in claim 1, wherein said protective sheet of said building board is made of a material to which conventional wood glue does not adhere well.

7. An architectural construction game as defined in claim 4, further comprising a cutter device adapted to cut said building elements.

8. An architectural construction game as defined in claim 1, wherein said building elements are wood sticks.

9. A building board for use in an architectural construction game, said building board comprising:

a board having a top surface provided with at least one recessed cavity having a predetermined depth suitable for housing a releasable fastening system consisting of two mutually engaging elements; each cavity being provided with the first of two releasably engaging elements mounted therein;

a protective sheet having an undersurface; said protective sheet being mountable so as to overly the top surface of the board; the second of two releasably engaging elements being mounted to the undersurface of the protective sheet in a position overlying said at least one recessed cavity when the protective sheet is mounted to overly the top surface of the board so as to releasably engage said first of two engaging elements.

10. A building board as defined in claim 9, wherein one of said two mutually engaging elements consists of VELCRO-type hook fastener material, the other of said two mutually engaging elements consists of VELCRO-type loop fastener material.

11. A building board as defined in claim 10, wherein the top surface of the board is rectangular, defining four corners, three of the four corners being provided with recessed cavities.

12. A building board as defined in claim 9, wherein said protective sheet is made of a transparent material.

13. A building board as defined in claim 9, wherein said protective sheet is made of a material to which conventional wood glue does not adhere well.

14. A kit of parts for constructing an architectural construction, said kit of parts comprising:

a plurality of building sticks;

a cutter device adapted to cut said building sticks;

a building board including:

a board having a top surface provided with at least one recessed cavity having a predetermined depth suitable for housing a releasable fastening system consisting of two mutually engaging elements; each cavity being provided with the first of two releasably engaging elements mounted therein;

a protective sheet made of a transparent material and having an undersurface; said protective sheet being mountable so as to overly the top surface of the board; the second of two releasably engaging elements being mounted to the undersurface of the protective sheet in a position overlying said at least one recessed cavity when the protective sheet is mounted to overly the top surface of the board so as to releasably engage said first of two engaging elements;

a plan mountable between the undersurface of the protective sheet and the top surface of the board.

15. A building board as defined in claim 14, wherein one of said two mutually engaging elements consists of VELCRO-type hook fastener material, the other of said two mutually engaging elements consists of VELCRO-type loop fastener material.

* * * * *